US008683728B2

(12) United States Patent
Inskeep et al.

(10) Patent No.: US 8,683,728 B2
(45) Date of Patent: Apr. 1, 2014

(54) BARREL SAFETY DEVICE

(71) Applicants: Wes Inskeep, El Cajon, CA (US); Craig Lathrop, San Diego, CA (US)

(72) Inventors: Wes Inskeep, El Cajon, CA (US); Craig Lathrop, San Diego, CA (US)

( * ) Notice: Subject to any disclaimer, the term of this patent is extended or adjusted under 35 U.S.C. 154(b) by 0 days.

(21) Appl. No.: 13/794,612

(22) Filed: Mar. 11, 2013

(65) Prior Publication Data

US 2013/0185976 A1 Jul. 25, 2013

Related U.S. Application Data

(63) Continuation of application No. 13/197,527, filed on Aug. 3, 2011, now abandoned.

(60) Provisional application No. 61/370,750, filed on Aug. 4, 2010.

(51) Int. Cl.
*F41A 17/44* (2006.01)

(52) U.S. Cl.
USPC ..... 42/70.01

(58) Field of Classification Search
USPC ..... 42/70.01, 70.11; 89/30, 31, 14.5
See application file for complete search history.

(56) References Cited

U.S. PATENT DOCUMENTS

| | | | | |
|---|---|---|---|---|
| 4,104,953 | A | | 8/1978 | Bard et al. |
| 4,128,040 | A | | 12/1978 | Schuetz |
| 4,224,753 | A | | 9/1980 | Bielman |
| 4,961,277 | A | | 10/1990 | Rosenbaum |
| 4,969,283 | A | | 11/1990 | Baehr |
| H926 | H | | 6/1991 | Mahtook |
| 5,140,893 | A | | 8/1992 | Leiter |
| 5,438,907 | A | * | 8/1995 | Reynolds et al. ..... 89/14.5 |
| 5,450,685 | A | * | 9/1995 | Peterson ..... 42/70.11 |
| 5,585,589 | A | | 12/1996 | Leiter |
| 5,740,626 | A | | 4/1998 | Schuetz et al. |
| 5,829,180 | A | | 11/1998 | Leiter |
| 5,937,563 | A | | 8/1999 | Schuetz et al. |
| 6,026,728 | A | | 2/2000 | Gühring et al. |
| 6,625,916 | B1 | | 9/2003 | Dionne |
| 6,796,072 | B2 | | 9/2004 | Barber et al. |
| 7,036,260 | B2 | | 5/2006 | Gee |
| 7,290,475 | B2 | | 11/2007 | Fluhr |
| 7,302,881 | B1 | | 12/2007 | Tertin |
| 7,302,890 | B2 | | 12/2007 | Saxby |
| 7,380,363 | B1 | | 6/2008 | Kirschner |
| 7,380,488 | B1 | | 6/2008 | Mao et al. |
| 2005/0188830 | A1 | | 9/2005 | Gee |

* cited by examiner

*Primary Examiner* — Michelle Clement
*Assistant Examiner* — John D Cooper
(74) *Attorney, Agent, or Firm* — Knobbe Martens Olson & Bear LLP

(57) ABSTRACT

Devices and methods for altering a firearm to prevent firing of rounds of a first size while allowing the firing of rounds of a smaller, second size are provided. In one embodiment, a barrel safety device prevents a live round from fully chambering in a firearm, while allowing a blank to be chambered and fired from the firearm. The barrel safety device includes a muzzle block, a rod, and a tip in one embodiment. The rod and the tip can be sized so as obstruct a portion of the barrel and/or the bullet chamber of the firearm, such that a round having a first length, such as a live round, contacts the tip of the barrel safety device and cannot be fully chambered. The rod and the tip can be sized so as to allow a cartridge having a second, smaller length, such as a blank cartridge, to be fully chambered without contacting the tip of the barrel safety device.

18 Claims, 11 Drawing Sheets

BARREL SAFETY DEVICE

CROSS-REFERENCE TO RELATED APPLICATIONS

The present application is a continuation of U.S. patent application Ser. No. 13/197,527, filed Aug. 3, 2011, which claims priority under 35 U.S.C. §119(e) to U.S. Provisional Patent Application Ser. No. 61/370,750, filed on Aug. 4, 2010. The disclosures of all of the above-referenced prior applications, publications, and patents are considered part of the disclosure of this application, and are incorporated by reference herein in their entirety.

BACKGROUND

1. Field of the Invention

The invention relates generally to training safety devices and methods, and, more particularly, to weapons safety devices for use during blank fire operations.

2. Description of the Related Art

Police and military forces conduct drills, simulated combat, and training exercises using blank ammunition instead of real, or live, ammunition. Extra precaution is required to ensure that firearm magazines are only loaded with blank cartridges during these exercises. Blank fire operations are nonetheless inherently dangerous, however, because a live cartridge, or round, may be mistakenly inserted into a firearm magazine, creating the possibility that a user will discharge the live round and injure or kill another participant. For example, in order to simulate combat against the enemy, blank-fire training often calls for a participant to "fire" a blank-loaded weapon at other participants in the training exercise who are acting as opposing forces. When a live round is accidentally introduced into the weapon and fired at a participant, serious injury and death may result.

Firing blanks from firearms generally designed to fire live ammunition involves special considerations. For example, firing a blank results in reduced barrel pressure compared to firing a live round, as a blank contains significantly less propellant (gunpowder) than a live round. Many weapons require a specific amount of barrel pressure, developed as the bullet courses down the barrel, to cycle the weapon's next round. To assist a firearm loaded with blanks to cycle properly with reduced barrel pressure, a blank fire adapter, or BFA, may be screwed on to the end of the firearm, occluding the barrel. The blank fire adapter can be configured to increase barrel pressure and cause the bolt of the firearm to cycle properly. In cases where a live round is accidentally fired from a firearm configured with a blank fire adapter, a bullet strikes the adapter and generally produces shrapnel and fragmentation similar to as if it had exploded. Such "explosions" are another potential cause of injury during blank-fire mishaps. Additionally, the bullet tends to continue through the blank fire adapter and toward whatever the weapon was pointed at. With the blank fire adapter now forcibly removed, nothing prevents a second round fired from having essentially normal operation.

Thus, preventing a live round from accidentally being loaded into a firearm and discharged during blank fire exercises, while taking into account special considerations associated with firing blanks, remains a significant challenge in military and law enforcement operations.

SUMMARY

The devices of the present invention have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description," one will understand how the features of this invention provide several advantages over current designs.

One embodiment is a device for converting a firearm capable of fully chambering a live round to a firearm only allowing a blank to be fully chambered, the blank having a length less than a length of the live round, the firearm including a muzzle, a barrel, and a bullet chamber. The device includes a rod configured to occupy a central portion of the muzzle and a central portion of the barrel when the device is installed in the firearm. The device also includes a tip disposed at a first end of the rod, the rod configured to position the tip within the barrel at a distance from the bullet chamber, the distance selected to allow a blank loaded into the firearm to fully chamber without contacting the tip, the distance further selected to place the tip in contact with a live round as the live round begins to be loaded into the bullet chamber, thereby preventing the live round from fully chambering. The device also includes a muzzle block disposed at a second end of the rod and configured for attachment to the muzzle of the firearm, the muzzle block further configured to, prevent a portion of exploding gasses emanating from a fired blank from escaping the barrel.

Another embodiment is an apparatus for preventing a firearm from chambering a live round while allowing a blank to be fully chambered, the blank having a length less than a length of the live round, the firearm having a barrel, a muzzle, and a bullet chamber. The apparatus includes a rod securable to the muzzle and having a sufficient length to extend from the muzzle down the barrel and interfere with the loading of the live round so as to prevent the live round from being chambered in the bullet chamber.

Another embodiment is an apparatus for preventing a firearm from chambering a live round while allowing a blank to be fully chambered, the blank having a length less than a length of the live round, the firearm having a barrel portion, a muzzle portion, and a bullet chamber. The apparatus includes an elongated rod having a tip disposed on an end of the rod, the elongated rod being releasably securable to the muzzle portion and having a length so that the tip occupies only a portion of the bullet chamber when the rod is secured to the muzzle portion.

BRIEF DESCRIPTION OF THE DRAWINGS

These and other features, aspects, and advantages of the present invention will now be described in connection with embodiments of the present invention, in reference to the accompanying drawings. The illustrated embodiments, however, are merely examples and are not intended to limit the invention.

DETAILED DESCRIPTION

The following detailed description is directed to certain specific embodiments of the invention. However, the invention can be embodied in a multitude of different ways. In this description, reference is made to the drawings wherein like parts are designated with like numerals throughout.

Embodiments of the invention can provide devices and methods to prevent live rounds from being introduced into a firearm. The following description describes embodiments of the invention with reference to a Caliber 5.56 mm M-16 rifle, the United States military's designation for the AR-15 rifle. Persons of skill in the art will understand, however, that the invention is not limited to the M-16 rifle, and can be implemented on any firearm. Similarly, any user of blank ammunition, in addition to military and law enforcement personnel, can use the devices and methods described herein.

Figure 1:
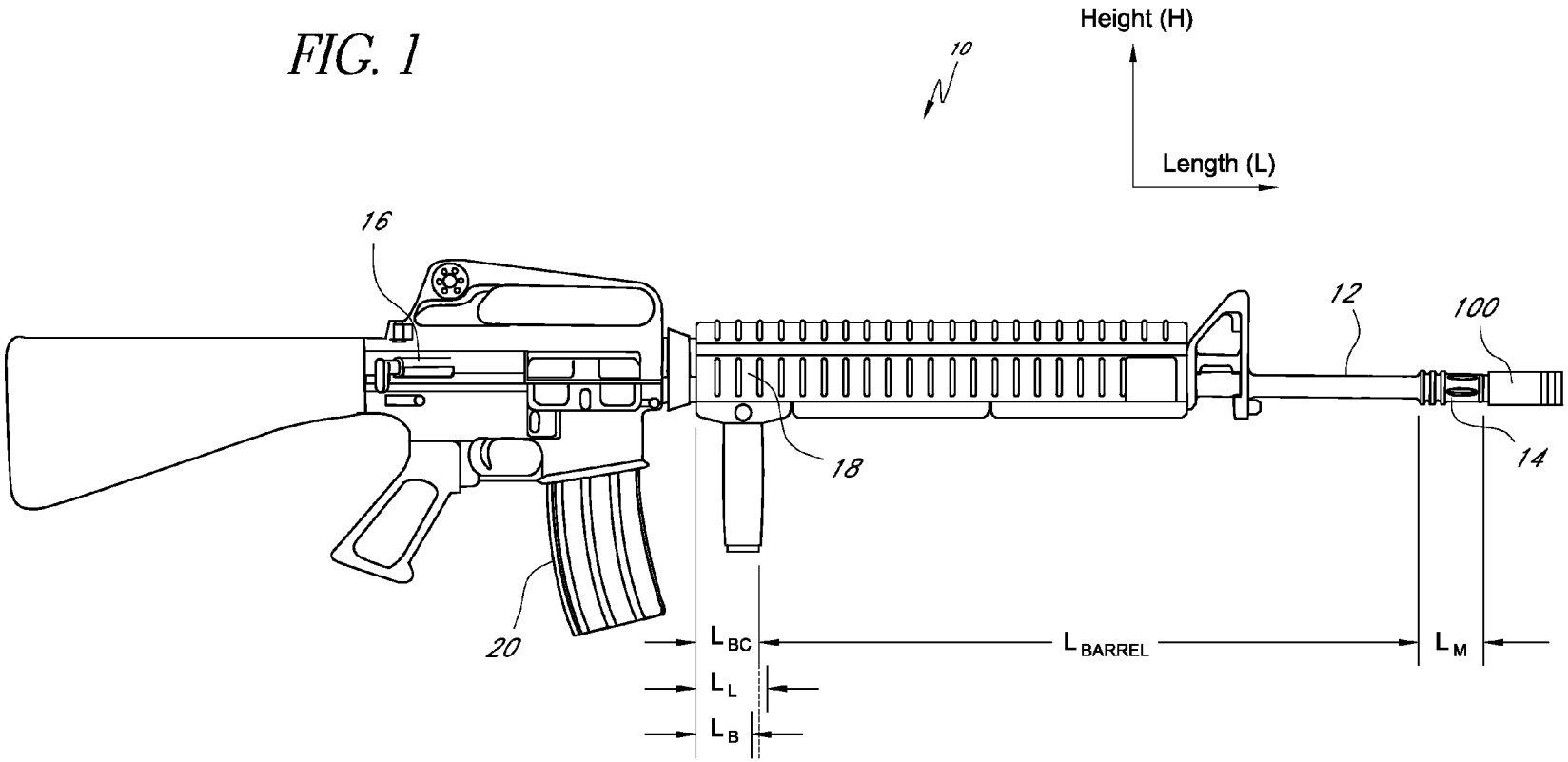
FIG. 1 is a side view of a firearm engaged with a barrel safety device that prevents the firearm from being loaded with a live round according to a preferred embodiment of the present invention.

FIG. 1 is a side view of a firearm 10, an M-16 A4 rifle, that is commonly used by military and police forces in hostile environments and live combat, as well as blank-fire operations. The firearm is engaged with a barrel safety device described below that prevents the firearm 10 from being loaded with live rounds. A member of the armed forces or law enforcement trainee may be issued one firearm 10, which is used for hostile activities and live-fire exercises on, for example, shooting ranges to practice marksmanship and teach weapons handling basics, such as loading, unloading, firing, and cleaning the weapon. The same firearm 10 may be used by the trainee during blank-fire training operations, thereby introducing the possibility that live rounds may accidentally be introduced into the firearm and discharged during blank-fire exercises if the barrel is not retrofitted with the safety device described below.

For instance, military and law enforcement training exercises frequently use the Multiple Integrated Laser Engagement System, or MILES, and the Deployable Instrumented Training System, or DITS, both advanced training systems that employ lasers and blanks to simulate actual battle. The systems allow users to fire blanks from a weapon, such as firearm 10, at friendly troops role playing as the enemy. Firing a blank through the weapon triggers a carefully aimed laser emitter mounted to the firearm 10. Sensors worn in various locations on the intended target's body register a hit, providing real-time event data. Training exercises using MILES and DITS can be particularly dangerous because they involve direct-fire, force-on-force training capabilities. Firearms 10, built and designed to be loaded with and to discharge live rounds, are instead loaded with blanks and aimed directly at friendly troops.

Thus, the firearm 10 is typically configured for blank-fire operations by emptying a standard magazine 20 of all rounds, then reloading the magazine 20 with blanks. However, a firearm 10 configured for blank-fire operations is still capable of firing live ammunition. Further, the magazine 20, in which blanks or live rounds may be loaded, generally appears the same independent of the type of rounds loaded in the magazine 20.

Figure 2:
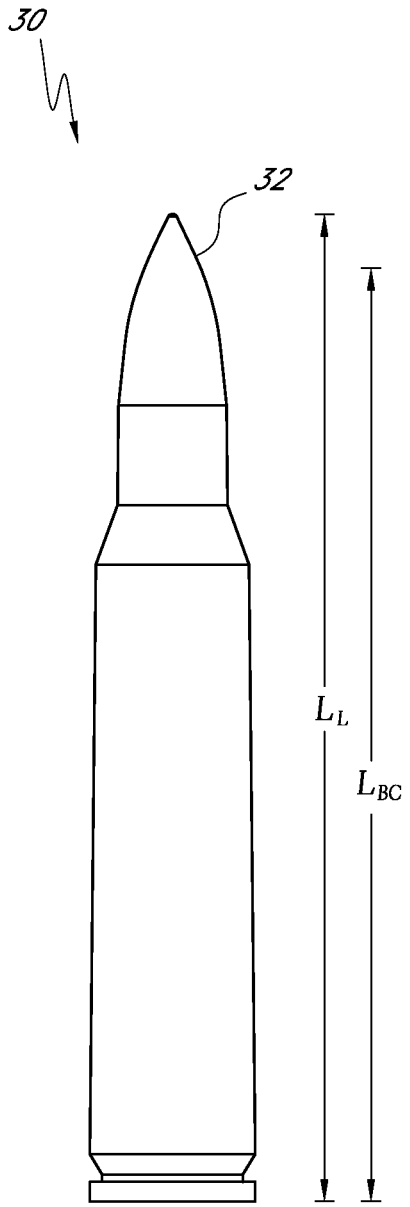
FIG. 2 is a side view of a live round which can be loaded into the firearm of FIG. 1 when the safety device is removed and can not be loaded into the firearm of FIG. 1 when the safety device is installed.
Figure 3:
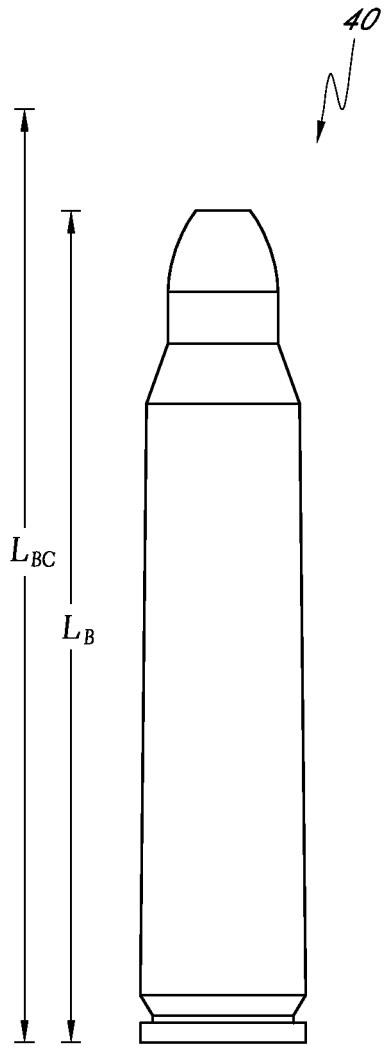
FIG. 3 is a side view of a blank which can be loaded into the firearm of FIG. 1 with or without the barrel safety device installed.

FIG. 2 is a side view of a live round 30 which can be loaded into the firearm of FIG. 1 when the barrel safety device is removed from the firearm and can not be loaded into the firearm of FIG. 1 when the safety device is installed within the barrel. FIG. 3 is a side view of a blank 40 which can be loaded into the firearm of FIG. 1 with or without the safety device installed. The live round 30 includes bullet 32, gunpowder, and primer packaged in a single metallic case. In contrast, the blank 40 includes gunpowder and primer, but no bullet. When the blank 40 is fired, it makes a flash and an explosive sound, simulating the effects of firing a live round 30. Because the blank 40 does not include a bullet, its length $L_B$ can be less than a length $L_L$ of the live round 40. For example, the live round 30 may be approximately 2.25 inches in length, while the blank 40 may be approximately 1.9 inches in length. Other lengths are possible.

Firing the blank 40 results in reduced barrel pressure compared to firing a live round 30. To assist a firearm 10 loaded with blanks 40 to cycle properly with reduced barrel pressure, a conventional blank fire adapter, or BFA, may be attached or screwed on to the end of the firearm 10, occluding the barrel 12 (FIG. 1). The blank fire adapter can be configured to restrict gasses from leaving the barrel, thereby increasing barrel pressure and causing the bolt of the firearm 10 to cycle and load the next cartridge. In cases where a live round 30 is accidentally fired from a firearm 10 configured with a conventional blank fire adapter, a bullet passes through the adapter, causing an explosion. Such explosions are another potential cause of injury during blank-fire mishaps.

Thus, a barrel safety device that can perform the functions of a conventional blank fire adapter while also preventing the chambering and firing of a live round 30 would be advantageous. Embodiments of the barrel safety device described herein are configured to increase barrel pressure to facilitate firing of a blank 40, thus fulfilling the role of a blank fire adapter, while simultaneously preventing a live round 30 from being introduced into the barrel 12 of the firearm 10. Accordingly, embodiments of the barrel safety devices described herein can reduce accidents during blank-fire operations.

Barrel Safety Device

The barrel safety device as described will also prevent the chambering and firing of a live round in the instance that the weapon does not need a Blank Fire Adapter to function properly when shooting blanks. Examples of this would be bolt action weapons.

Figure 4:
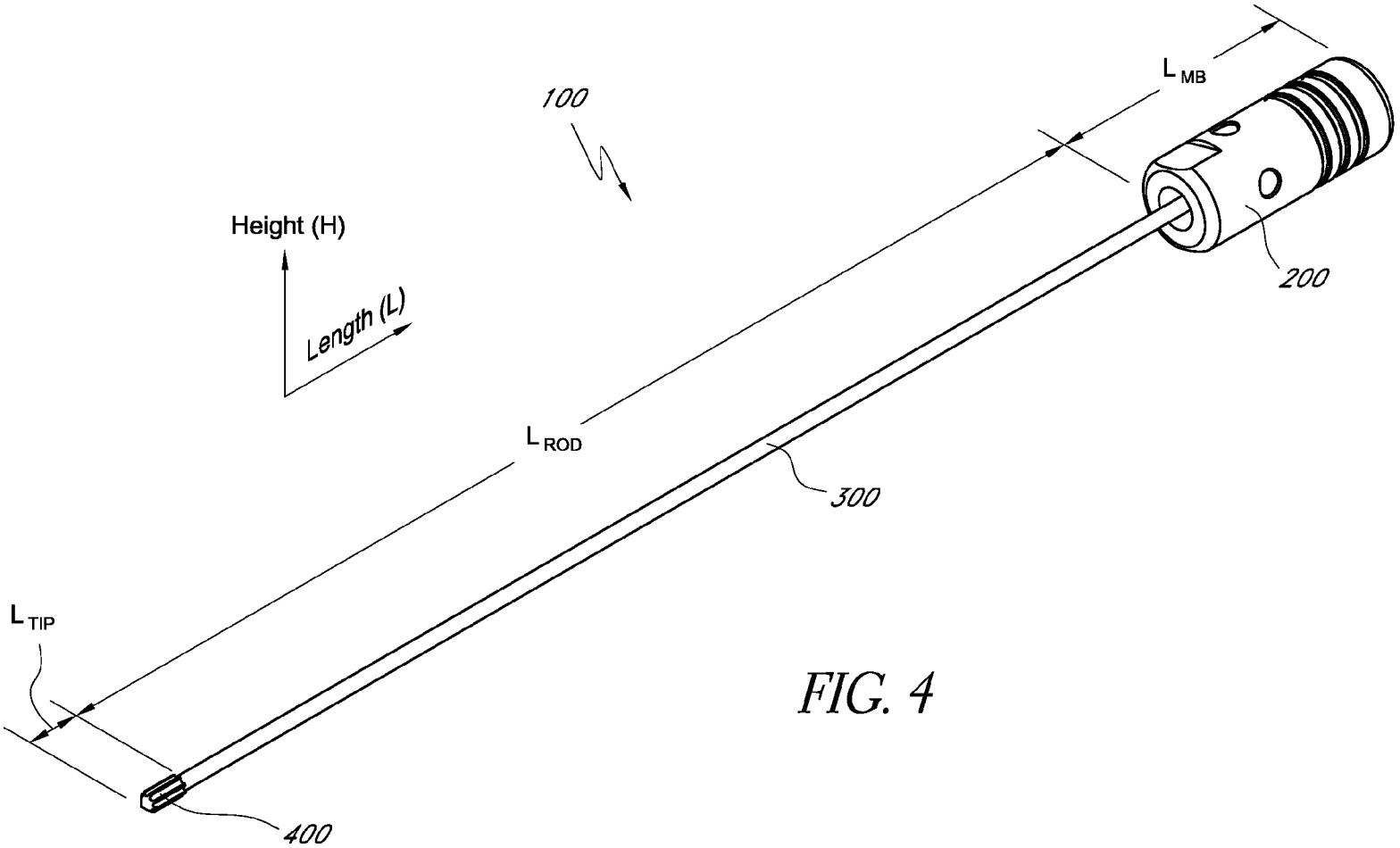
FIG. 4 is a perspective view of the barrel safety device from FIG. 1.
Figure 5:
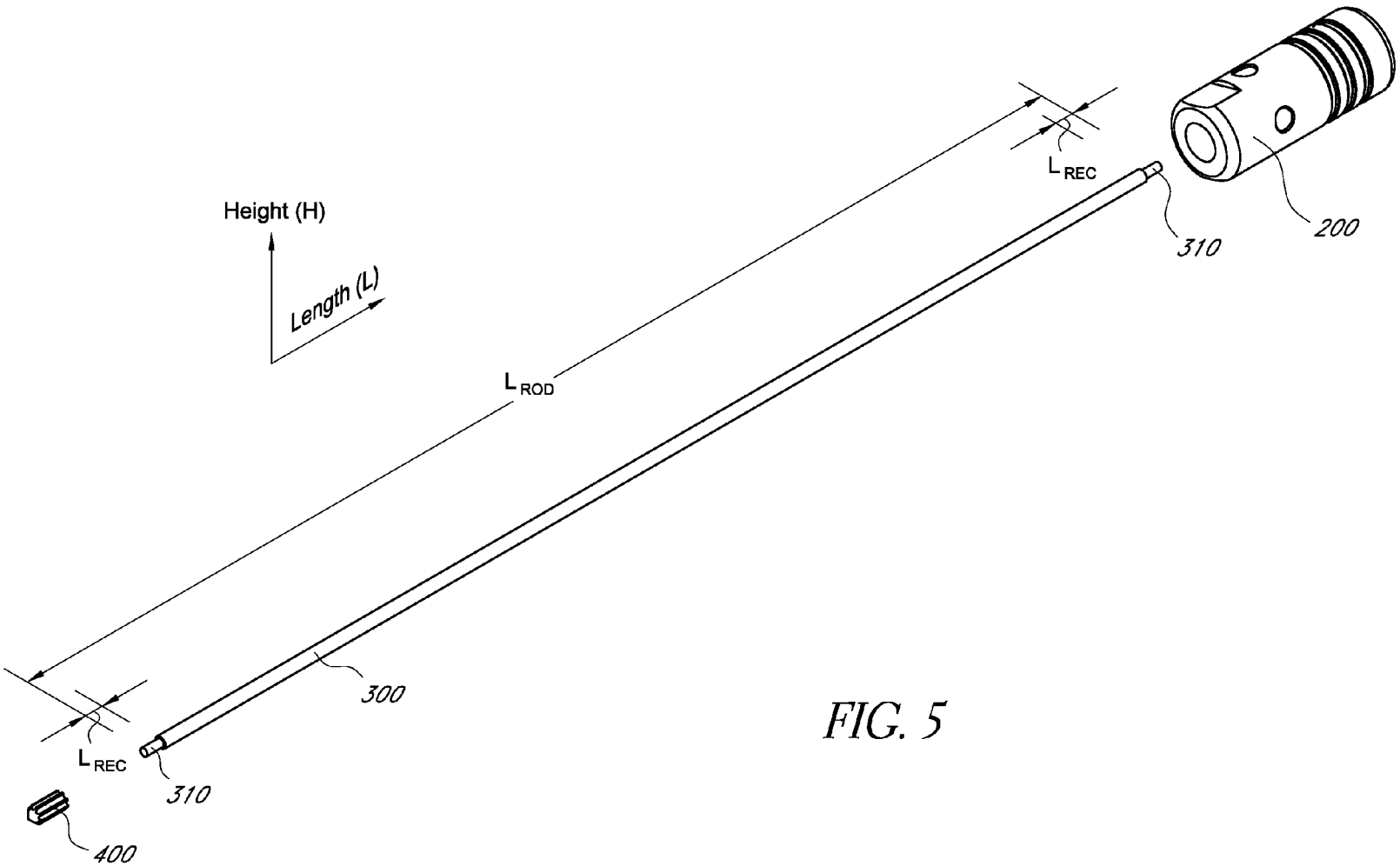
FIG. 5 is an exploded view of the barrel safety device from FIG. 4.

FIG. 4 is a perspective view of a barrel safety device 100 partially illustrated in FIG. 1. The barrel safety device 100 is shown assembled together prior to installation in the firearm 10. FIG. 5 is an exploded view of the barrel safety device of FIG. 4. As will be described in greater detail below, embodiments of the barrel safety device 100 can physically prevent a live round 30 from fully chambering in the firearm 10, thus interrupting the firing cycle of the firearm 10 and preventing the firearm 10 from firing the live round 30. Advantageously, embodiments of the safety device 100 can eliminate or decrease the likelihood that a live round will be fired during a blank-fire operation. The barrel safety device 100 thus allows a significant increase in firearm safety, in particular firearm safety during blank-fire operations when live rounds 30 may be accidently introduced into the magazine 20 of a firearm 10, or may be accidentally left inside a magazine 20, unbeknownst to a user who thinks the magazine 20 only contains blanks.

In some aspects, the larger size of a live round 30, in comparison to a blank 40, provides interference with the chambering process to prevent the chambering of the live round 30. For example, as described above, a live round 30 may be more than ¼ inch longer than a blank 40. Persons of skill in the art will understand, however, that embodiments of the barrel safety device 100 are not limited to blocking live rounds 30, and can be used to prevent firing of any number of rounds of a first size while allow the firing of rounds of a smaller, second size.

Now referring to FIGS. 1 and 2, the barrel 12 of the firearm has a length $L_{BARREL}$ that is generally measured from the muzzle 14 to a bullet chamber 18 of the firearm 10. The bullet chamber 18 has a length $L_{BC}$. The firearm 10 also includes a muzzle 14 having a length $L_M$. Typically, when a round or blank is properly loaded into the firearm 10, the round or blank is fully chambered in the bullet chamber 18, allowing the firearm 10 to fire and a bolt 16 to cycle and load the next round or blank. In the case of a properly-loaded, fully-chambered live round 30, the live round 30 occupies the entire length $L_{BC}$ of the bullet chamber 18 and a portion of the bullet 32 extends forward of the bullet chamber 18 and into the barrel 12. The relationship of $L_L$ of a live round 30 and the $L_{BC}$ of the bullet chamber 18 is illustrated in FIGS. 1 and 2. In the case of a properly-loaded, fully-chambered blank 40, the blank 40 occupies a portion of the length $L_{BC}$ of the bullet chamber 18, as illustrated in FIGS. 1 and 3. The lengths illustrated in FIGS. 1, 2, and 3 may not be to scale.

Referring now to FIGS. 4 and 5, embodiments of the barrel safety device 100 include a muzzle block 200, a rod 300, and a tip 400. The muzzle block 200 has a length $L_{MB}$, the rod 300 has a length $L_{ROD}$, and the tip has a length $L_{TIP}$. The tip 400 may screw onto or into the rod 300. In some aspects, the rod 300 integrally includes a tip 400 such that the device 100 does not include a separate tip 400. The diameter $D_{ROD}$ of the rod 300 and the diameter $D_{TIP}$ of the tip 400 are less than the diameters of the barrel 12, the muzzle 14, and the bullet chamber 18 to allow insertion into portions of the barrel 12, the muzzle 14, and the bullet chamber 18.

Figure 6A:
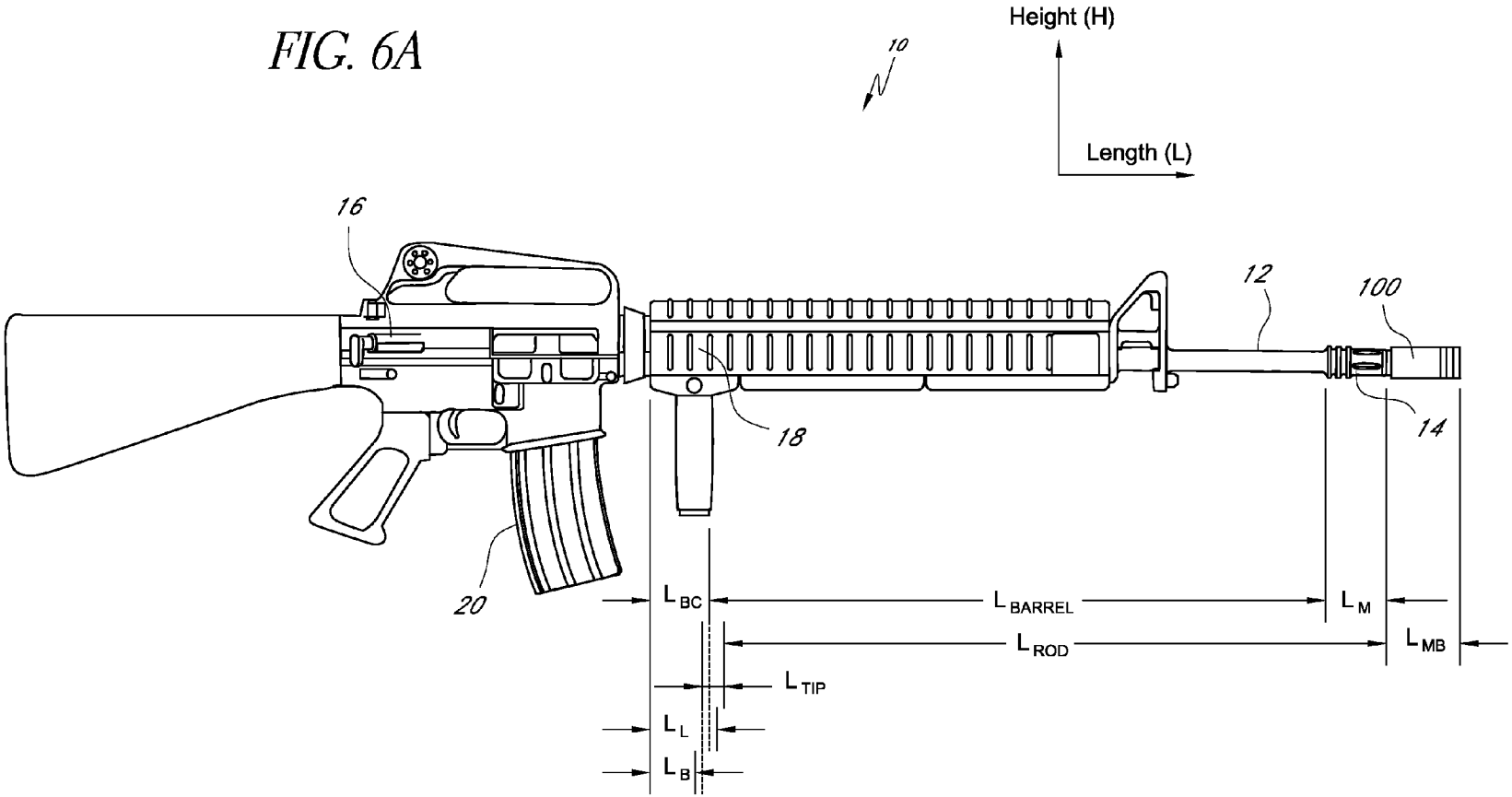
FIGS. 6A-6C are side views of the firearm 10 illustrated in FIG. 1, engaged with different embodiments of a barrel safety device.
Figure 6B:
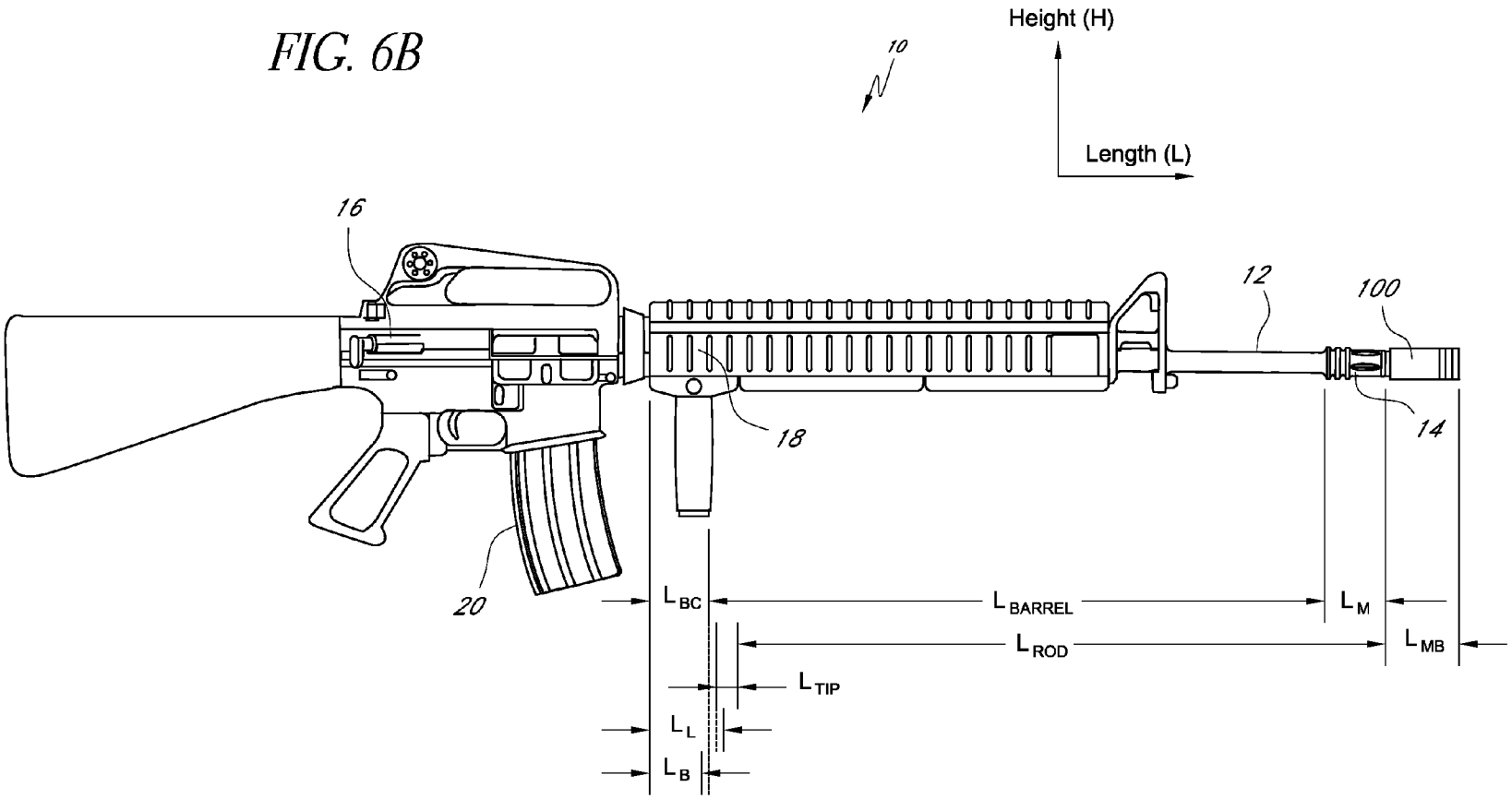
Figure 6C:
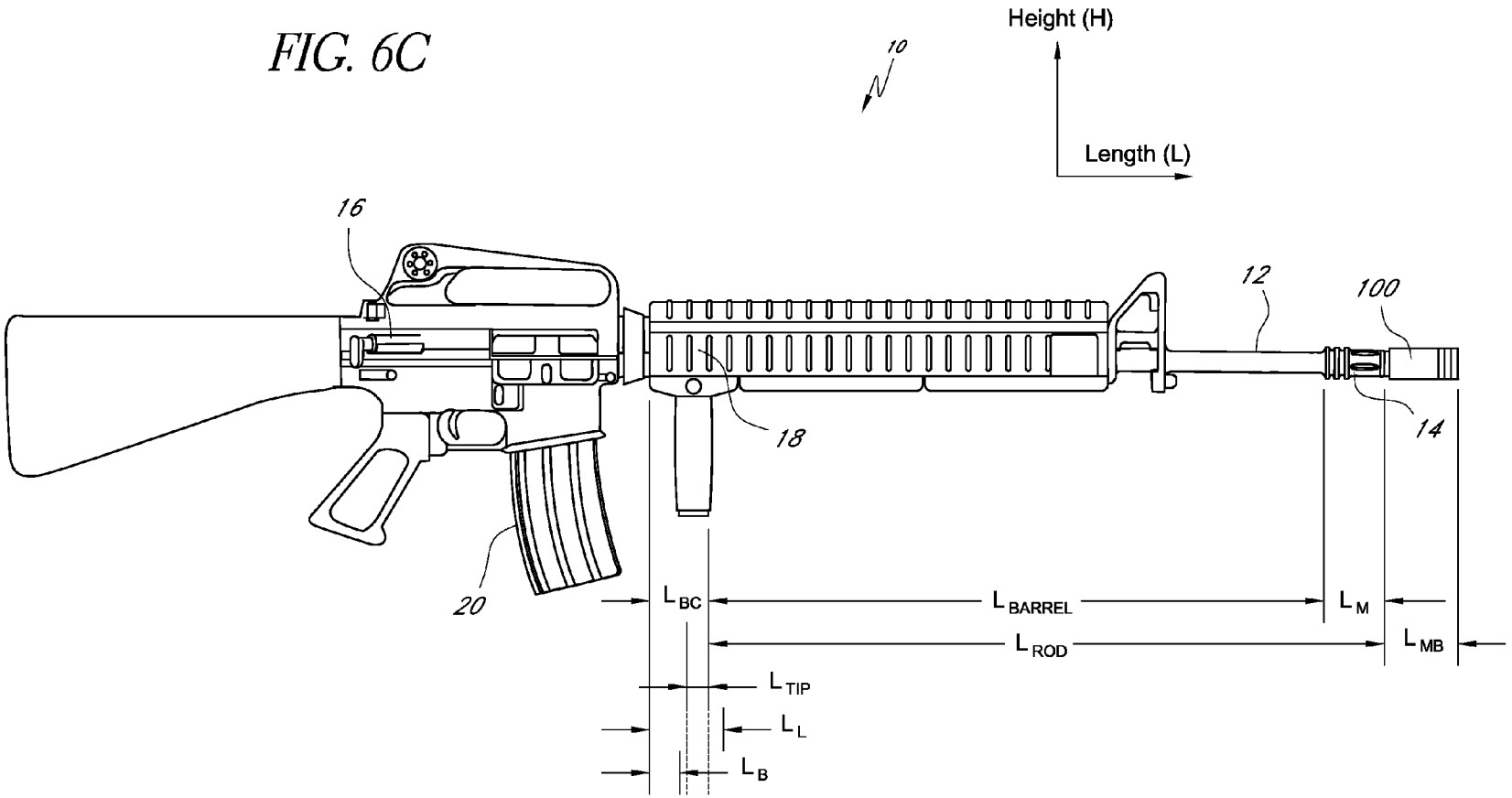

FIGS. 6A-6C are side views of the firearm 10 illustrated in FIG. 1, engaged with different embodiments of the barrel safety device 100. The lengths illustrated may not be to scale. To install the device 100 onto the firearm 10, the muzzle block 200, the rod 300, and the tip 400, if separate from the rod 300, are assembled together as shown in FIG. 4. The device 100 is installed onto the firearm 10 by feeding the rod 300 along the length axis L of the firearm 10, through the muzzle 14 into a portion of the barrel 12, such that the tip 400 is positioned to interfere with the loading of live round 30 into the bullet chamber. Generally, the tip 400 obstructs a portion of the bullet chamber 18 and/or a portion of the barrel's length $L_{BARREL}$ such that a live round 30 cannot be fully chambered in the bullet chamber 18, while a blank 40 can be fully chambered in the bullet chamber 18 without interference from the tip 400.

In one embodiment of the barrel safety device 100 illustrated in FIG. 6A, the tip 400 is positioned to occupy a portion of the barrel 12 and a portion of the bullet chamber 18, such that the bullet 32 of a live round 30 cannot fully enter the bullet chamber 18. For example, a first portion of the tip 400 can occupy a portion of the bullet chamber 18 and a second portion of the tip 400 can occupy a portion of the barrel 12. In this embodiment, the rod 300 occupies a central portion of the barrel 12 along a portion of the barrel's length $L_{BARREL}$. As shown in FIG. 6A, a properly-loaded blank 40 can be fully chambered in the bullet chamber 18, while a live round 30 cannot be fully chambered in the bullet chamber 18 due to interference with the tip 400.

In another embodiment illustrated in FIG. 6B, the tip 400 does not occupy a portion of the barrel chamber 18, but is positioned to occupy a portion of the barrel 12 that the bullet 32 of a properly-loaded, fully-chambered live round 30 would normally occupy, thus preventing the live round 30 from becoming fully chambered. In this embodiment, the rod 300 occupies a central portion of the barrel 12 along a portion of the barrel's length $L_{BARREL}$. As shown in FIG. 6B, a properly-loaded blank 40 can be fully chambered in the bullet chamber 18, while a live round 30 cannot be fully chambered in the bullet chamber 18 due to interference with the tip 400.

In yet another embodiment illustrated in FIG. 6C, the entire tip 400 is positioned within the bullet chamber 18, thus preventing a live round 30 from fully entering the bullet chamber 18. The tip 400 is dimensioned, however, so as to still allow a blank 40 to be fully chambered in the bullet chamber 18. A portion of the rod 300 may or may not also be positioned in the bullet chamber 18. For example, the rod 300 can extend along the entire length of the barrel $L_{BARREL}$ and, as shown in FIG. 6C, terminate at the junction between the bullet chamber 18 and the barrel 12. Alternatively, the rod 300 can extend into a portion of the bullet chamber 18 (not shown in FIG. 6C). As shown in FIG. 6C, a properly-loaded blank 40 can be fully chambered in the bullet chamber 18, while a live round 30 cannot be fully chambered in the bullet chamber 18 due to interference with the tip 400.

Following installation of the rod 300 and the tip 400, the muzzle block 200 is then attached to the muzzle 14 of the barrel 12. In some aspects, the muzzle block 200 screws onto or into the muzzle 14. After installation, the rod 300 occupies a central portion of the muzzle 14 along the entire length of the muzzle $L_M$.

One of skill in the art will understand that the devices described herein can be used in many different types of firearms, which may or may not include a bullet chamber that is separate from a barrel. The device 100, for example, can obstruct a portion of a barrel of a firearm that would normally be fully occupied by a properly-loaded, fully chambered live round, while not obstructing a blank from being loaded and fully chambered in the barrel.

In operation, the rod 300 extends down a portion of the length $L_{BARREL}$ of the barrel 12 and positions the tip 400 at a specific point within or in front of the bullet chamber 18. A portion of the tip, none of the tip 400, or all of the tip 400 can be disposed within the bullet chamber 18 (as shown in FIGS. 6A, 6B, and 6C respectively). In each embodiment, the length of the rod 300 and the tip 400 $L_{ROD+TIP}$ is sized such that a blank 40 loaded into the firearm 10 does not touch or interact with the tip 400. The length of the rod 300 and the tip 400 $L_{ROD+TIP}$ is also sized, however, such that when a user attempts to load a live round 30 into the firearm 10, the live round 30 contacts or interacts with the tip 400. This interaction between the live round 30 and the tip 400 does not allow the bolt 16 to fully return home and lock. The live round 30 thus does not fully chamber in the barrel 12, and the firearm 10 will not fire.

Thus, in some aspects of the present invention, the larger size and/or longer length of the live round 30 provides interference between the round 30 and the barrel safety device 100, in order to interrupt the chambering process and prevent the round 30 from being fully loaded and fired from the firearm 10. The presence and location of the tip 400 within the barrel 12 and/or the bullet chamber 18 can prevent the live round 30 from becoming fully chambered.

It will be understood that embodiments of the barrel safety device 100 are not limited to preventing a live round 30 from fully chambering, and can prevent any caliber round or cartridge of a specific length from being fired from the firearm 10. In some aspects, for example, the length of the rod 300 and the tip 400 $L_{ROD+TIP}$ is selected or adjusted so that the tip 400 extends down the barrel 12 to a specific distance within or in front of the bullet chamber such that the round having a specific length is obstructed and cannot fully chamber.

Rod

Referring now to FIG. 5, the barrel safety device 100 can include a rod 300 configured to extend down the barrel 12 and position the tip 400 within or in front of the bullet chamber 18. The rod 300 may comprise a solid or hollow cylinder. The rod 300 can have a length $L_{ROD}$ that is approximately 15 inches long. In one embodiment, the rod 300 is 15.4 inches long. In another embodiment, the rod 300 is 15.37 inches long. As described above, other lengths are possible based on the length of the round whose loading should be prevented or impeded by the barrel safety device 100. The rod 300 may have a diameter $D_{ROD}$ of approximately 0.2 inches. In one embodiment, the rod 300 has a diameter of 0.16 inches.

As used herein, the term "about" or "approximately" means within an acceptable error range for the particular value as determined by one of ordinary skill in the art, which will depend in part on how the value is measured or determined, e.g., the limitations of the measurement system. For example, "about" can mean within 1 or more than 1 standard deviation, per the practice in the art. Alternatively, "about" can mean a range of up to 20%, preferably up to 10%, more preferably up to 5%, and more preferably still up to 1% of a given value. In one embodiment, an approximately 15 inch-long rod means a rod that is 15 inches long plus or minus 1%. In another embodiment, an approximately 15 inch-long rod means a rod that is 15 inches plus or minus 5%. Where particular values are described in the application and claims, unless otherwise stated the terms "about" and "approximately" meaning within an acceptable error range for the particular value should be assumed.

The rod 300 may include receivers 310 on each end. The receivers 310 can have a length $L_{REC}$ of approximately 0.25 inches. The receivers 310 engage with the tip 400 and the muzzle block 200, and assist in assembly of the barrel safety device 100 prior to installation in the firearm 10. The receivers 310 can optionally comprise threads (not shown in FIG. 5) configured to engage with threads on the tip 400 and the muzzle block 200.

The rod 300 may be made of any suitable material, such as but not limited to metal. In some aspects, the rod 300 comprises stainless steel.

Tip

Figure 7:
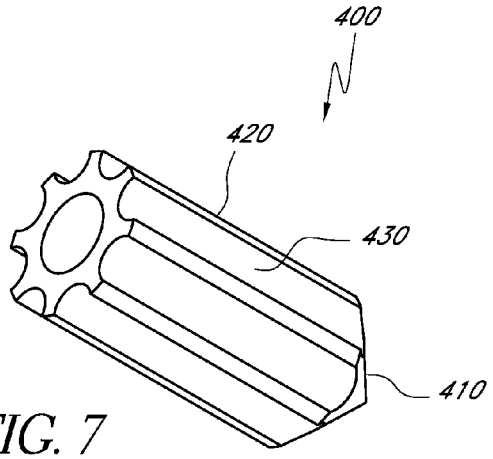
FIG. 7 is a perspective view of a tip of the barrel safety device from FIG. 4.
Figure 8:
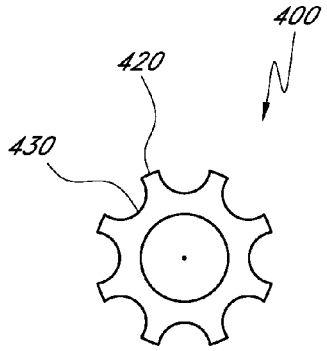
FIG. 8 is a bottom elevation view of the tip of FIG. 7.
Figure 9:
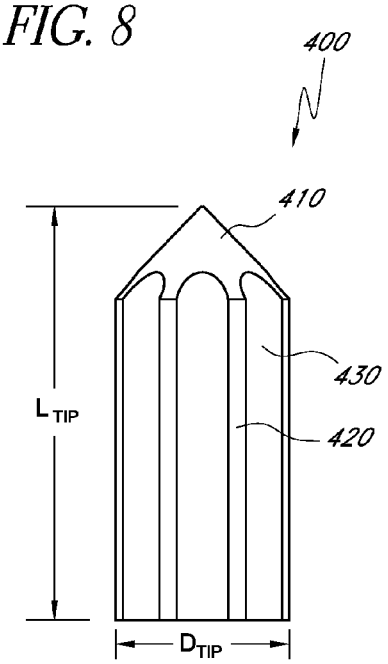
FIG. 9 is a side elevation view of the tip of FIG. 7.

FIG. 7 is a perspective view of one embodiment of a tip 400 of the barrel safety device 100. FIG. 8 is a bottom elevation view of the tip 400, and FIG. 9 is a side elevation view of the tip 400. The tip 400 can be formed in the shape of a cylinder with a cone-shaped head 410. Other configurations are within the scope of this disclosure. The tip 400 can also comprise flutes 420 and vents 430. In the embodiment illustrated in FIGS. 7-9, the tip 400 comprises eight flutes 420 and eight vents 430, but other configurations are possible. The tip 400 may comprise 1, 2, 3, 4, 5, 6, 7, or more flutes, for example.

In one embodiment in which blanks 40 are loaded into and fired from the firearm 10, the cone-shaped head 410 and the vents 430 allow exploding gasses from the fired blank 40 to bypass or pass around the tip 400 and travel unimpeded through the barrel 12 to the muzzle block 200. As described in greater detail below, the muzzle block 200 can function as a blank fire adapter to obstruct gasses and increase pressure in the barrel in order to cycle the weapon.

In another embodiment, the tip 400 is formed in the shape of a cylinder with a chisel-shaped head. The chisel-shaped head can cause the tip 400 to bend as the loading mechanism or the user attempts to load the live round 30 into the bullet chamber 18. For example, the neck of the tip 400 may bend as the live round 30 is compacted against the tip 400 during the attempted loading operation. The bent neck of the tip 400 can create additional friction and/or interference between the live round 30 and the tip 400, further reducing the ability of the live round 30 to push into the neck of the tip 400 and become properly seated or loaded in the bullet chamber 18.

The tip 400 can be made of any suitable material, such as but not limited to metal. In some aspects, the tip 400 comprises a soft metal which is configured to bend, as described above, when a live round 30 pushes into the tip 400 during an attempt to load the round 30. In other aspects, the tip 400 comprises brass, tungsten, or stainless steel.

In one embodiment, the tip 400 has a length $L_{TIP}$ of approximately 0.5 inches. As described above, other lengths are possible to prevent a round or cartridge of a specific length from becoming fully chambered in the bullet chamber 18. In some aspects, the tip 400 has a diameter $D_{TIP}$ of approximately 0.22 inches.

Figure 10:
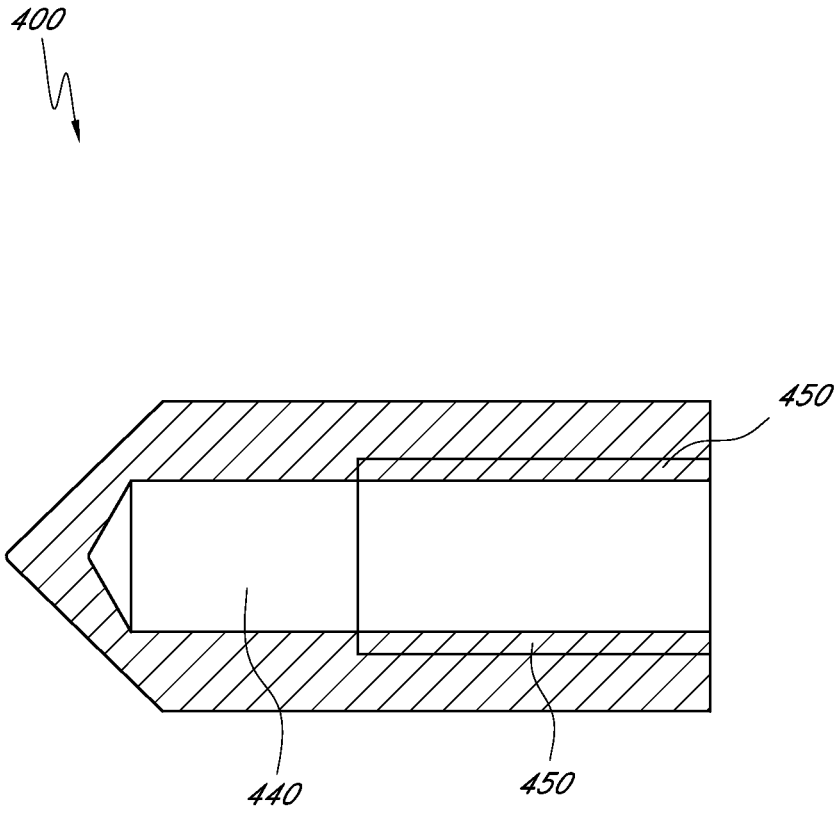
FIG. 10 is a cross-sectional side view of the tip of FIG. 7.

FIG. 10 is a cross-sectional view of the tip 400. The tip 400 can include flutes 420 or vents 430, which are not illustrated in FIG. 10. The tip 400 may comprise a channel 440 for receiving a portion of the rod 300. The tip 400 can also include threads 450 to engage threads on the receivers 310 of the rod 300. Mechanisms to attach the tip 400 and the rod 300 are not limited to threads, however, and any suitable method for attaching the tip 400 with the rod 300 is possible. The tip 400 can also be integrally formed with the rod 300, such that the tip 400 and the rod 300 need not be assembled together.

Muzzle Block

Figure 11:
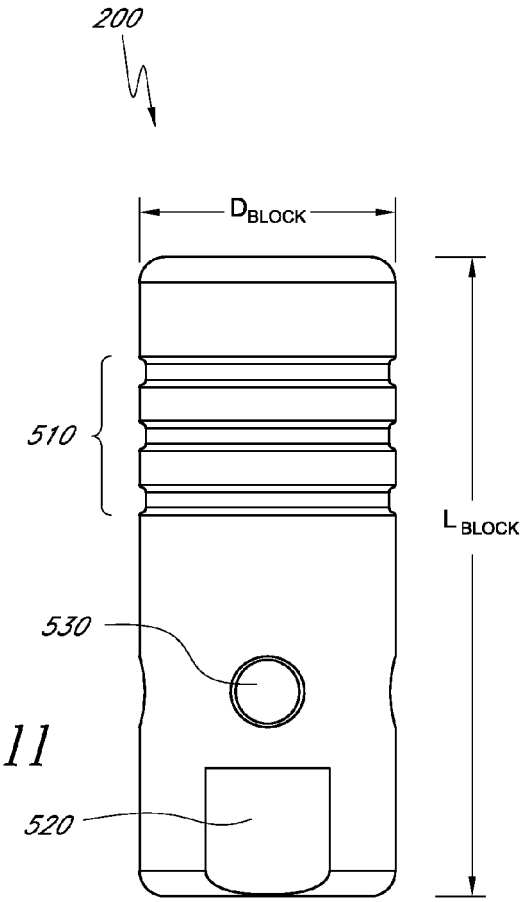
FIG. 11 is a first side elevation view of a muzzle block of the barrel safety device of FIG. 4.
Figure 12:
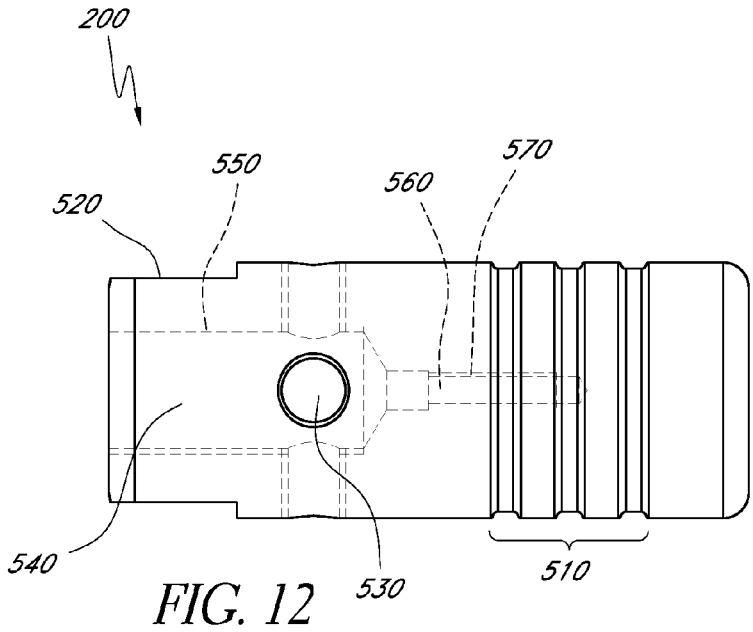
FIG. 12 is a second side elevation view of the muzzle block of FIG. 11, with interior features illustrated in dashed lines.
Figure 14:
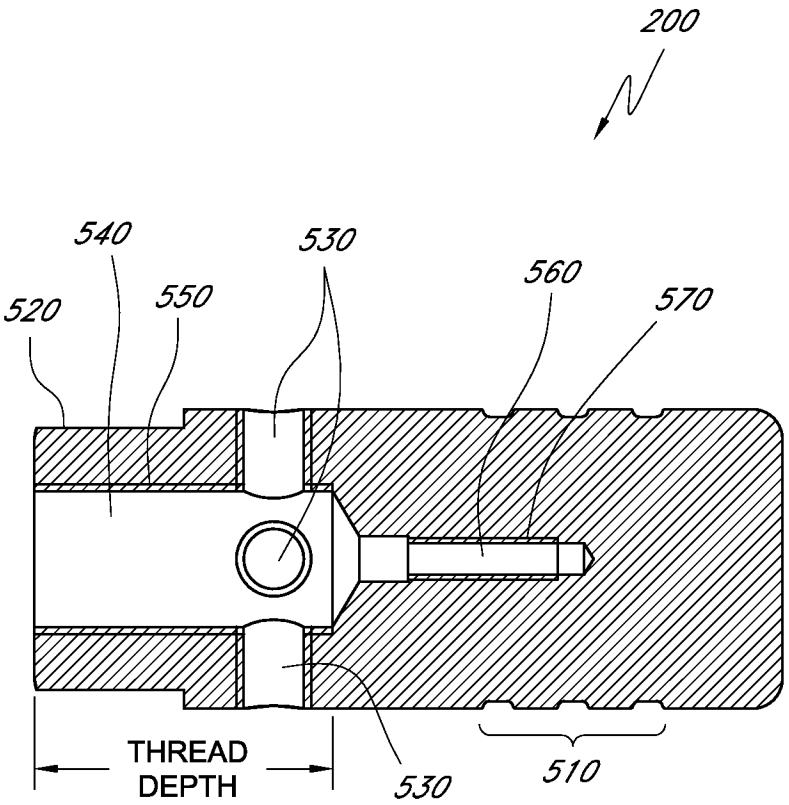
FIG. 14 is a cross-sectional side view of the muzzle block of FIG. 11.
Figure 13:
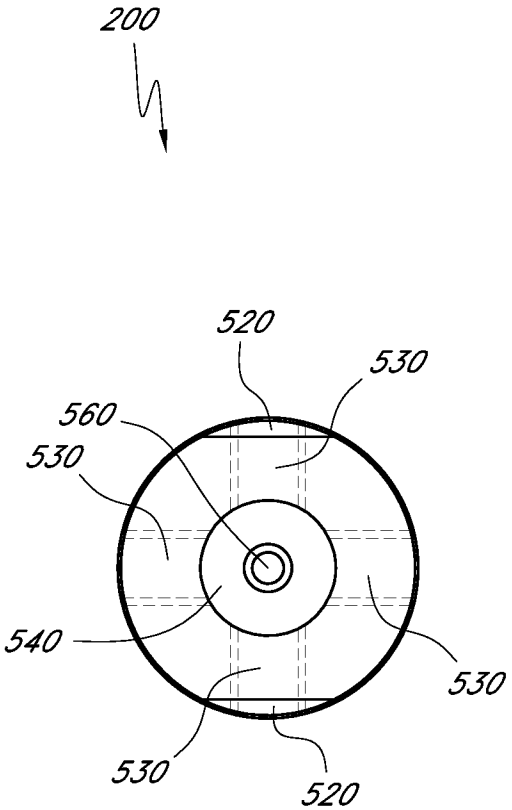
FIG. 13 is a bottom elevation view of the muzzle block of FIG. 11.

FIG. 11 is a first side elevation view of one embodiment of a muzzle block 200 of the barrel safety device 100. FIG. 12 is a second side elevation view of the muzzle block 200, with interior features illustrated in dashed lines. FIG. 13 is a bottom elevation view of the muzzle block 200, and FIG. 14 is a cross-sectional side view of the muzzle block 200. The muzzle block 200 can be configured to perform some or all of the functions of a conventional blank fire adapter, as described in greater detail above. In one embodiment, the muzzle block 200 prevents a portion of the exploding gasses emanating from a fired blank 40 from escaping the barrel 12, allowing the bolt 16 to cycle and load the next blank 40.

The muzzle block 200 can have a length $L_{BLOCK}$ of approximately 2.5 inches. The muzzle block 200 can have a diameter $D_{BLOCK}$ of approximately 1.0 inches. Embodiments of the muzzle block 200 can include rings 510 and recesses 520. In one embodiment, the muzzle block 200 includes vents 530 to allow exploding gasses to escape the barrel 12 when a blank 40 is fired. The muzzle block 200 can include four vents 530 evenly spaced around the periphery of the block 200, but other numbers and configurations of vents are possible.

The muzzle block 200 includes a channel 540 to receive the muzzle 14 of the firearm 10. In some embodiments, the channel 540 comprises threads 550 to allow the muzzle block 200 to screw on to the muzzle 14 during installation of the device 100 onto the firearm 10. In one embodiment, the threads 550 extend into the channel 540 to a depth ("thread depth") of approximately 1.0 inches.

The muzzle block 200 can also include a channel 560 to receive the rod 300 when the device 100 is assembled. The channel 560 can comprise threads 570 to engage threads on the receiver 310 of the rod 300, for example. Mechanisms to attach the rod 300 to the muzzle block 200 and to attach the muzzle block 200 to the firearm 10 are not limited to threads, however, and any suitable method for attaching the rod 300, the muzzle block 200, and the muzzle 14 is possible.

The muzzle block 200 may be made of any suitable material, such as but not limited to metal. In some aspects, the muzzle block 200 comprises aluminum.

Advantageously, embodiments of the barrel safety device 100 described herein can prevent the firing of a live round 30 independent of the presence or absence of other firearm safety devices. For example, magazine safety devices may be installed into the magazine 20 of the firearm 10 and prevent the loading of one or more live rounds 30 into the magazine 20. It is possible, however, for a user to handle a firearm 10 under the mistaken belief that a magazine safety device has been installed in the magazine 20, and will prevent a live round 30 from being introduced into or fired from the firearm 10. If the firearm 10 does not in fact have a magazine safety device installed, installation of embodiments of the safety barrel device 100 can advantageously prevent a live round 30 from being loaded into and fired from the firearm 10. Additionally, if the magazine safety device does not function properly or should allow a live round 30 to be loaded as the last round in the magazine 20, embodiments of the safety barrel device 100 can again prevent the live round 30 from fully chambering and being fired from the firearm 10.

It will also be understood that embodiments of the barrel safety device 100 can prevent serious injuries associated with the use of a conventional blank fire adapter. As described above, in cases where a live round 30 is accidentally fired from a firearm 10 configured with a conventional blank fire adapter, a bullet passes through the adapter, causing an explosion. Such explosions can cause serious injury or death. Embodiments of the barrel safety device 100 can altogether prevent a live round 30 from being loaded into the firearm 10, thus eliminating the potential cause of injury associated with a live round being accidentally fired and passing through a device fitted on the muzzle 16 of the firearm 10.

While the above detailed description has shown, described, and pointed out novel features of the invention as applied to various embodiments, it will be understood that various omissions, substitutions, and changes in the form and details of the devices and methods illustrated may be made by those skilled in the art without departing from the spirit of the invention. As will be recognized, the invention may be embodied within a form that does not provide all of the features and benefits set forth herein, as some features may be used or practiced separately from others.

What is claimed is:

1. A device for converting a firearm capable of fully chambering a live round to a firearm only allowing a blank to be fully chambered, the blank having a length less than a length of the live round, the firearm including a muzzle, a barrel, and a bullet chamber, the device comprising:

a rod sized and shaped to occupy a central portion of the muzzle and a central portion of the barrel when the device is installed in the firearm;

a tip disposed at a first end of the rod, the rod configured to position the tip within the barrel at a distance from the bullet chamber, the distance selected to allow a blank loaded into the firearm to fully chamber without contacting the tip, the distance further selected to place the tip in contact with a live round as the live round begins to be loaded into the bullet chamber, thereby preventing the live round from fully chambering;

a muzzle block disposed at a second end of the rod and configured for attachment to the muzzle of the firearm, the muzzle block further configured to prevent a portion of exploding gasses emanating from a fired blank from escaping the barrel, the tip comprising a cone-shaped head and a plurality of vents configured to allow a portion of the exploding gases to travel unimpeded to the muzzle block.

2. The device of claim 1, wherein the tip comprises a channel configured to receive the first end of the rod.

3. The device of claim 1, wherein the muzzle block comprises a channel configured to receive the second end of the rod.

4. The device of claim 1, wherein the muzzle block comprises a channel configured to receive the muzzle of the firearm.

5. The device of claim 1, wherein the rod comprises a first receiver configured to engage the tip and a second receiver configured to engage the muzzle block.

6. The device of claim 5, wherein the first receiver and the second receiver comprise threads configured to engage with threads on the tip and the muzzle.

7. The device of claim 1, wherein the tip is integrally formed into the first end of the rod.

8. An apparatus for preventing a firearm from chambering a live round while allowing a blank to be fully chambered, the blank having a length less than a length of the live round, the firearm having a barrel, a muzzle, and a bullet chamber, the apparatus comprising:

a rod securable to the muzzle and having a sufficient length to extend from the muzzle down the barrel and interfere with the loading of the live round so as to prevent the live round from being chambered in the bullet chamber, the rod comprising a tip, the tip comprising a cone-shaped head and a plurality of vents configured to allow a portion of exploding gases to travel unimpeded to the muzzle.

9. The apparatus of claim 8, wherein the rod is sized and shaped to occupy a central portion of the muzzle and a central portion of the barrel when the apparatus is installed in the firearm.

10. The apparatus of claim 8, wherein the rod is sized and shaped such that the tip is disposed within the bullet chamber when the apparatus is installed in the firearm.

11. The apparatus of claim 10, wherein the tip extends into only a portion of the bullet chamber when the apparatus is installed in the firearm.

12. The apparatus of claim 8, wherein the length of the live round is greater than a length of the bullet chamber, and wherein the tip does not extend into the bullet chamber when the apparatus is installed in the firearm.

13. The apparatus of claim 8, further comprising a muzzle block disposed at an end of the rod.

14. The apparatus of claim 13, wherein the muzzle block is sized and shaped to inhibit at least a portion of exploding gasses emanating from a fired blank from exiting the muzzle.

15. An apparatus for preventing a firearm from chambering a live round while allowing a blank to be fully chambered, the blank having a length less than a length of the live round, the firearm having a barrel portion, a muzzle portion, and a bullet chamber, the apparatus comprising:

an elongated rod having a tip disposed on an end of the rod, the elongated rod being releasably securable to the muzzle portion and having a length so that the tip occupies only a portion of the bullet chamber when the rod is secured to the muzzle portion, the tip comprising a cone-shaped head and a plurality of vents configured to allow a portion of exploding gases to travel unimpeded to the muzzle portion.

16. The apparatus of claim 15, wherein the tip interferes with the live round so as to prevent the live round from being chambered in the bullet chamber when the apparatus is installed in the firearm.

17. The apparatus of claim 15, further comprising a muzzle block disposed at another end of the rod, the muzzle block being releasably securable to the muzzle portion.

18. The apparatus of claim 17, wherein the muzzle block is sized and shaped to inhibit at least a portion of exploding gasses emanating from a fired blank from exiting the muzzle portion.

* * * * *